US006935519B2

(12) United States Patent
Lawson et al.

(10) Patent No.: US 6,935,519 B2
(45) Date of Patent: Aug. 30, 2005

(54) PANTS/SKIRTS CLOSET RACK

(76) Inventors: Stephen John Lawson, 871 Wavertree Road, North Vancouver, British Columbia (CA) V7R 1S2; Christopher Dale Isfeld, 36081 Regal Parkway, Abbotsford, British Columbia (CA) V3G 1L1

( * ) Notice: Subject to any disclaimer, the term of this patent is extended or adjusted under 35 U.S.C. 154(b) by 69 days.

(21) Appl. No.: 10/763,477

(22) Filed: Jan. 26, 2004

(65) Prior Publication Data

US 2005/0161417 A1 Jul. 28, 2005

(51) Int. Cl.[7] ..... A47F 5/08
(52) U.S. Cl. ..... 211/94.02
(58) Field of Search ..... 211/94.02, 85.3, 211/162, 85.31, 85.24, 85.29, 113, 119, 124, 211/151, 204, 206; 223/85, 95, 96

(56) References Cited

U.S. PATENT DOCUMENTS 1,206,769 A * 11/1916 Wheary ..... 211/7
1,371,612 A * 3/1921 Espenlaub et al. ..... 211/94.02
2,087,149 A 7/1937 Hendrix
3,069,020 A * 12/1962 Sans ..... 211/162
4,323,162 A 4/1982 Steinhilber
4,625,873 A 12/1986 Hayashi
6,340,092 B1 1/2002 McGrath, Jr.
6,394,286 B1 5/2002 Dueck

* cited by examiner

*Primary Examiner*—Peter M. Cuomo
*Assistant Examiner*—Sarah Purol
(74) *Attorney, Agent, or Firm*—Frederick Kaufman

(57) ABSTRACT

A pants/skirts closet rack, according to the present invention, adaptable to be installed horizontally into a closet receptacle, comprises right and left attachments, front and back tubular elements, a pair of slides of ball bearing drawer type and several hangers. Each of the pair of slides is located, in an interior part of the right and left attachments. The front and back tubular elements, respectively their ends, penetrate into, without passing through, the right and left attachments. The ends are secured to the right and left attachments and to one side of the pair of slides of ball bearing drawer type. Another side of the pair of slides of ball bearing drawer type is secured to the closet receptacle, respectively to its spaced vertical walls. The hanger includes a crossbar, adapted to extend beneath and forwardly beyond right and left attachments.

3 Claims, 3 Drawing Sheets

PANTS/SKIRTS CLOSET RACK

I. BACKGROUND OF THE INVENTION

1. Field the Invention

The present invention generally relates to devices for hanging items of clothing in a limited space, and more particularly, to a pants/skirts closet rack.

2. Description of the Prior Art

Attempts have been made in the past to design closet racks, which would achieve good results in the adaptability to limited spaces, in their simplicity and price. Thus, U.S. Pat. No. 5,5785,184, issued Jul. 28, 1998 and granted to Metselaar for a "STAND WITH HANGERS FOR ITEMS OF CLOTHING" describes a self supporting device. The device comprises laterally projecting extension arms that are received in bearings for rotation. Metselaar's stand has a main disadvantage which resides in the use of cantilevered arms that affects the stability and structural rigidity of the stand. U.S. Pat. No. 5,535,896, issued Jul. 16, 1996 and granted to Morgan, Sr. for a "HANGING APPARATUS FOR MULTIPLE TROUSERS" refers to an apparatus using a multiplicity of pivotal rods or dowels for hanging trousers or/and skirts. An elongated base, mounted on a vertical wall, supports the pivotal rods which are pivotally mounted, one atop the other. Any garment may be accessed by swinging all of the garments above it to one side and all of the garments below it to another side of the bar, leaving the garment free on its rod. As can be seen from the foregoing succinct description, the hanging apparatus is operationally relatively complicated and lacks an appropriate stability and rigidity.

There are also available on the market several pants racks: REV-A-SHELF (www.rev-a-shelf.com); ROCKLER (www.rockler.com); SEEMANS (www.seemans.co.uk); HAMMACHER SCHLEMMER (www.hammacher.com); and HARDWARE HUT (www.thehardwarehut.com). The applicants believe that none of these items anticipate nor render obvious the submitted pants/skirts closet rack.

II. SUMMARY OF THE INVENTION

There is accordingly a need for a pants/skirts closet rack that overcomes the limitations of the prior art.

Thus, it is an objective of the present invention to provide a versatile pants/skirts closet rack adaptable for use in conjunction with closet receptacles of different widths.

It is another objective of the present invention that access to any selected pants or skirt be readily made without disarranging any of the others items and without any significant effort.

It is still another objective of the present invention to provide a pants/skirts closet rack with transversally movable hangers for conveniently selecting the distance between the latter.

It is yet a further objective of the present invention to judiciously use the confined spaces available in closet receptacles.

It is another objective of the present invention to design a hanger with such a configuration that allows an easy grip and handle.

Broadly stating, a pants/skirts closet rack, according to the present invention is adaptable to be installed horizontally into a closet receptacle and comprises right and left attachments;

front and back tubular elements;

a pair of slides of ball bearing drawer type; and several hangers.

Each of the pair of slides of ball bearing drawer type is located, almost entirely, in an interior part of the right and left attachments. The front and back tubular elements, respectively their ends, penetrate into, without passing through, the right and left attachments. The ends are secured to the right and left attachments and to one side of the pair of slides of ball bearing drawer type. Another side of the pair of slides of ball bearing drawer type is adapted to be secured to the closet receptacle, respectively to its spaced vertical walls. The right attachment has basically a C-shaped cross-section and an interior provided with a longitudinal vertical wall extending along a whole length of the right attachment. The right attachment has also a pair of spaced circular apertures, centrally located in an external wall of the right attachment, and is provided with a diameter commensurate with the external diameter of the front and back tubular elements, so that ends of the front and back tubular elements after traversing the external wall abut against the longitudinal vertical wall. The latter is provided with attachment perforations corresponding to and coplanar with the pair of spaced circular apertures. The left attachment has an identical structure with the right attachment and is so positioned to constitute a mirror image of the right attachment. The front and back tubular elements incorporate in their interior elements for capturing threaded ends of fasteners. The fasteners are used for securing together the one side of the pair of slides of ball bearing drawer type, the longitudinal vertical wall and, respectively, the front and back tubular elements.

In one aspect of the present invention the means for capturing threaded ends of fasteners are incorporated in each front or back tubular element and comprises a pair of internal, diametrically opposed screw chases, which is intended to capture threaded ends of a predetermined diameter. The pair of internal, diametrically opposed screw chases project from an internal surface of each front and back tubular elements, and extend along the whole length of the latter. Each internal, diametrically opposed screw chase has, in cross-section, an annular discontinuous shape with an opening towards the longitudinal axis of symmetry of the front and back tubular elements.

In another aspect of this invention, a hanger is adapted for use with a pants/skirts closet rack. This rack comprises right and left attachments, front and back tubular elements and a pair of slides of ball bearing drawer type. Each of said pair of slides of ball bearing drawer type is located, almost entirely, in an interior part of the right and left attachments. The front and back tubular elements, respectively their ends, penetrate into, without passing through, the right and left attachments. The ends are secured to the right and left attachments and to one side of slides, another side of the pair of slides of ball bearing drawer type is adapted to be secured to the receptacle, respectively to its spaced vertical walls. The hanger includes a crossbar, adapted to extend beneath and forwardly beyond right and left attachments, has a front end bent vertically and upwardly and then backwardly for forming a segment parallel to the crossbar. The segment further extends upwardly for forming a first backwardly directed front hook. The crossbar has also a back end bent vertically and upwardly and then backwardly for forming a second backwardly directed back hook. The first and second backwardly directed front and back hooks are coplanar with the crossbar and have the same height with respect to the crossbar. Their openings are commensurate with the external diameter of the front and back tubular elements.

III. BRIEF DESCRIPTION OF THE DRAWINGS

The subject matter of the invention is particularly pointed out and distinctively claimed in the concluding portion of the specification. The invention, however, both in structure and operation may be better understood by reference to the following description taken in conjunction with the subjoined claims and the accompanying drawings of which:

IV. DESCRIPTION OF THE PREFERRED EMBODIMENT

Figure 1:
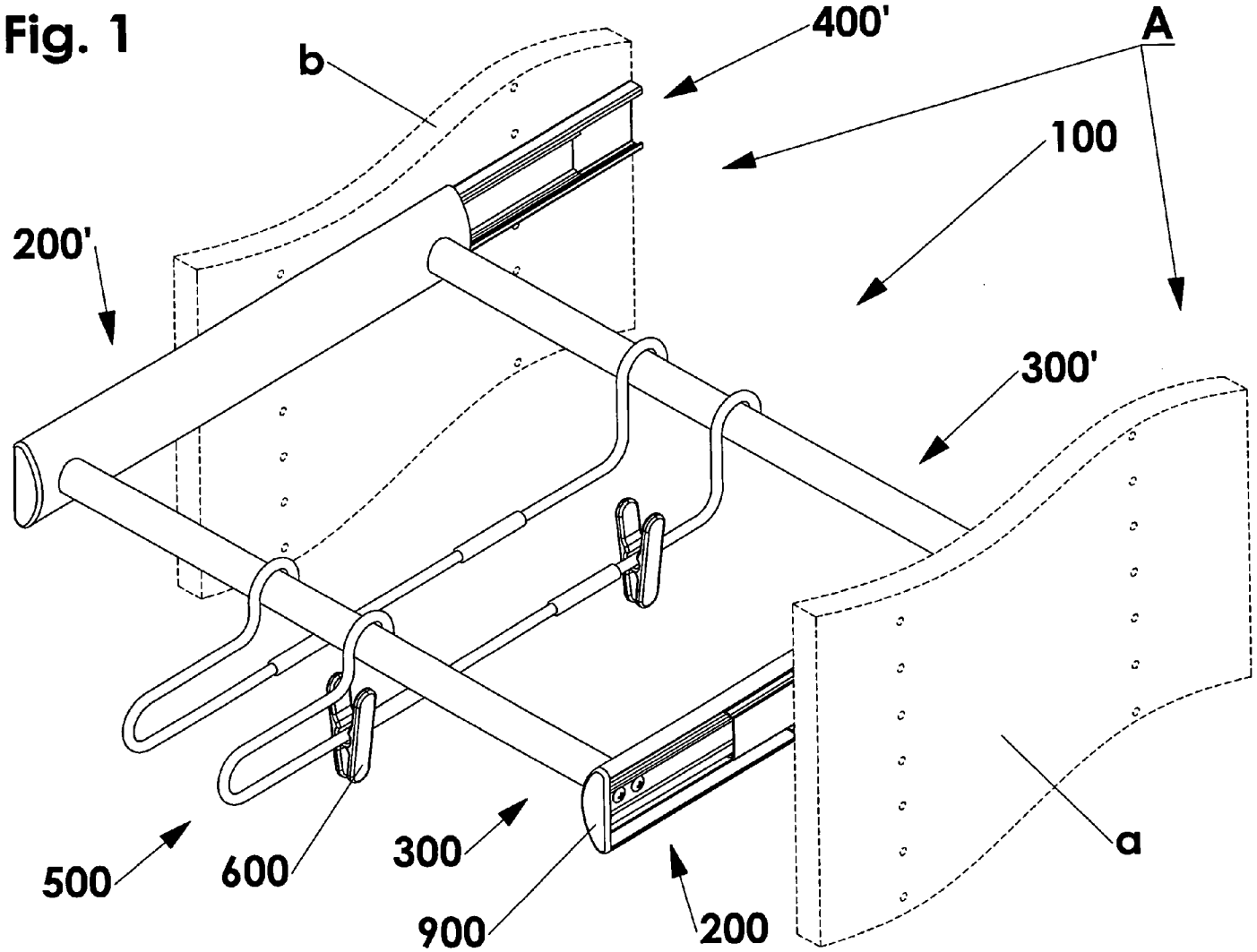
FIG. 1 shows a fragmentary perspective view of a closet receptacle, wherein the present invention is installed.

The accompanying figures best illustrate the preferred embodiment of a pants/skirts closet rack according to the present invention, which is designated generally by numeral 100.

Pants/skirts closet rack 100 is installed horizontally into a closet receptacle A and comprises four basic subassemblies: 1) parallel and transversally spaced, longitudinally extending right and left 200 and 200' attachments (which will be referred to as right and left attachments 200 and 200', hereinafter); 2) parallel and longitudinally spaced, transversally extending front and back tubular elements (which will be referred to as front and back tubular elements 300 and 300', hereinafter); 3) a pair of ball bearing drawer slides 400 and 400' (which will be referred as slides 400 and 400', hereinafter); 4) several hangers 500; and 5) optionally, a plurality of laundry line type clips 600. Slides 400 and 400' are respectively located, almost entirely, in an interior part of each one of the right and left 200 and 200' attachments. Front and back tubular elements 300 and 300', more specifically their ends, penetrate into, without passing through, right and left attachments 200 and 200', wherein they are secured to right and left 200 and 200' attachments and to one side 402(402') of slides 400 and 400', respectively. Another side 404(404') of slides 400 and 400' is adapted to be secured using conventional means (not shown) to closet receptacle A, respectively to its spaced vertical walls a and b.

Figure 2:
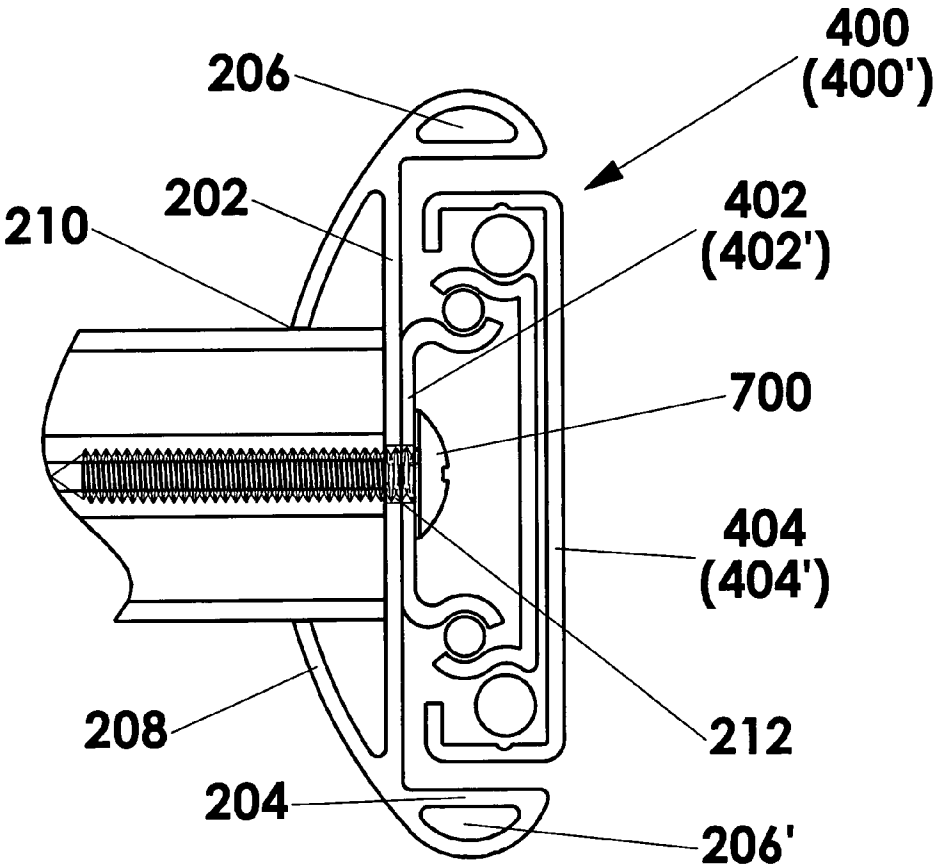
FIG. 2 shows partially a vertical cross-section through the longitudinal axis of a front or back tubular element and a complete cross-section through a slide and a right attachment.
Figure 4:
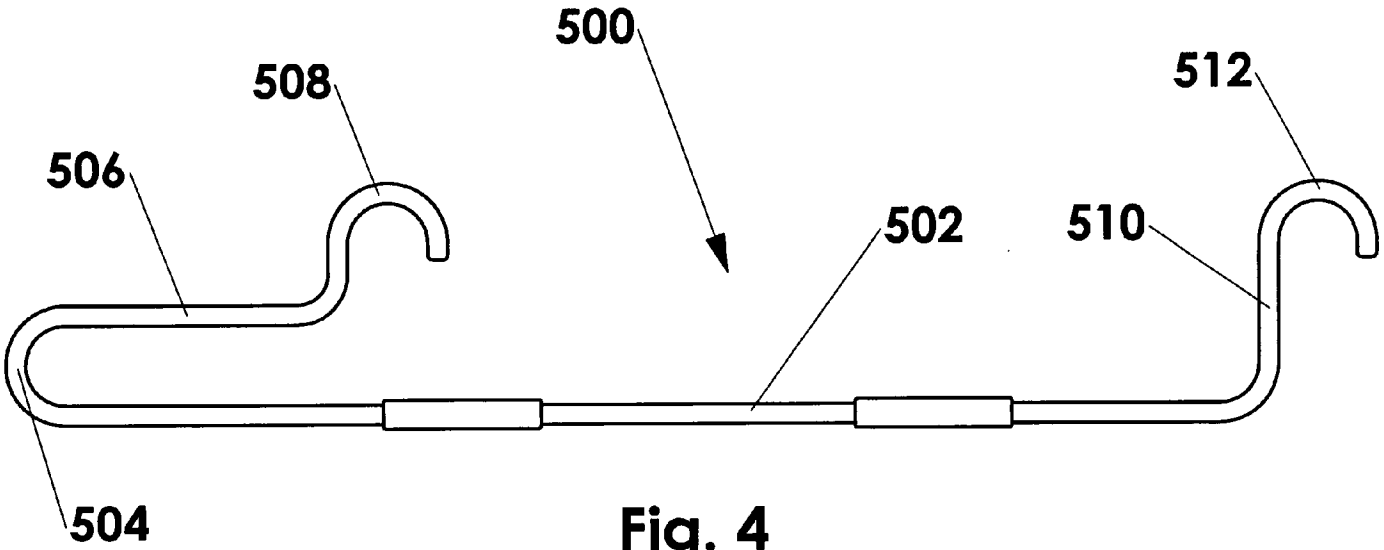
FIG. 4 shows a side view of a hanger according to the present invention.
Figure 3:
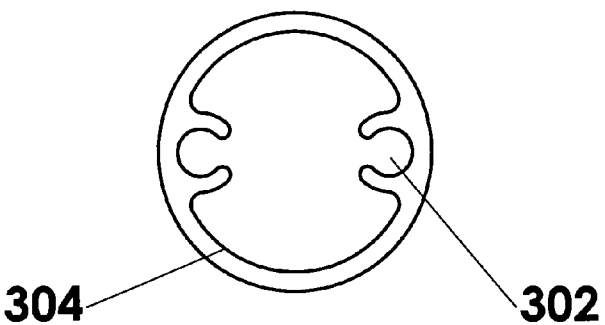
FIG. 3 shows an end view of a front or back tubular element 300(300') according to the present invention.

Describing now in detail with reference to FIGS. 1–4, right attachment 200 is, in general, C-shaped in cross-section and has in its interior a medial, longitudinal vertical wall 202 (referred as longitudinal vertical wall 202, hereinafter) that extends at each vertical extremity into a horizontal wall 204. The latter abuts an end of C-shaped cross-section right attachment 200. Top and bottom longitudinal cavities 206 and 206' result. Both longitudinal vertical wall 202 and the pair of horizontal walls 204 are integral part of right attachment 200 and extend along its whole length. An external wall 208 of right attachment 200 is provided centrally with a pair of spaced circular apertures 210. The diameter of each of the spaced apertures 210 is so adjusted that front and back tubular elements 300 and 300', respectively their ends, can pass through external wall 208 until they abut against longitudinal vertical wall 202. The latter is provided with attachment perforations 212 facing spaced apertures 210. The role of attachment perforations 212 will be described further in this disclosure.

Left attachment 200' is structurally identical with right attachment 200; the only difference resides in the fact that the former is inversely positioned with respect to the latter, namely, left attachment 200' constitutes a mirror image of right attachment 200.

Each front or back tubular element 300 or 300' incorporates a pair of internal, diametrically opposed screw chases 302 (hereinafter referred as opposed screw chases 302) and intended to capture threaded ends of a predetermined diameter. The opposed screw chases 302 project from an internal surface 304 of each front and back tubular elements 300 and 300' and extend along the whole length of the latter. The opposed screw chases 302 are integral part of front and back tubular elements 300 and 300' and each has, in cross-section, an annular discontinuous shape with an opening towards the longitudinal axis of symmetry of front and back tubular elements 300 and 300'.

Other features, disposed in tubular elements 300 and 300' for securing them to right and left attachments 200 and 200' and to one side 402(402') of slides 400 and 400' can be readily envisioned by those familiar with the field.

Each hanger 500 has a crossbar 502 adapted to extend beneath and forwardly beyond right and left attachments 200 and 200'. Crossbar 502 has a front end 504 bent vertically and upwardly and then backwardly where it forms, parallel to itself, a segment 506. The latter further extends upwardly, forming a first backwardly directed front hook 508.

Crossbar 502 has a back end 510 bent vertically and upwardly and then backwardly forming a second backwardly directed back hook 512. First and second backwardly directed front and back hooks 508 and 512 are coplanar with crossbar 502 and have the same height with respect to the crossbar 502, their openings being commensurate with the external diameter of front and back tubular elements 300 and 300'.

Hanger 500 having a configuration such as results from the foregoing description, enables a user to install the back of pants/skirts closet rack 100 flush to a back wall (not shown) of closet receptacle A. The fact each hanger 500 is easily detachable, renders it convenient to be used outside closet receptacle A (for suspending or removing pants or skirts from hangers 500).

A pair of self tapping screws 700 or similar threaded fasteners are inserted, through one side 402(402') of slides 400 and 400' and through a pair of attachment perforations 212, and then fastened into a pair of opposed screw chases 302 of front or back tubular elements 300 and 300'.

A cap 900 is provided for each front end of right and left attachments 200 and 200'. Cap 900 is provided with inwardly projecting ribs (not shown) for longitudinal insertion into top and bottom longitudinal cavities 206 and 206'.

Since right and left attachments 200 and 200' and front and back tubular elements 300 and 300' are firmly but not permanently secured together, pants/skirts closet rack 100 can be adapted, by conveniently choosing the length of front and back tubular elements 300 and 300' to fit to closet receptacles A of different widths.

Right and left attachments 200 and 200' and front and back tubular elements 300 and 300' are made of aluminum by extrusion.

When pants/skirts closet rack 100 is used for suspending, for example, a skirt to a hanger 500, a pair of laundry line type clips 600 is employed.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

What is claimed is:

1. A pants/skirts closet rack, adapted to be installed horizontally into a closet receptacle, said pants/skirts closet rack comprising, in combination, right and left attachments;

front and back tubular elements;

a pair of slides of ball bearing drawer type; and several hangers;

each of said pair of slides of ball bearing drawer type being located, almost entirely, in an interior part of said right and left attachments, said front and back tubular elements, respectively their ends, penetrating into, without passing through, said right and left attachments, said ends being secured to said right and left attachments and to one side of said pair of slides of ball bearing drawer type, another side of said pair of slides of ball bearing drawer type being adapted to be secured to spaced walls of said closet receptacle;

said right attachment having basically a C-shaped cross-section and an interior provided with a longitudinal vertical wall extending along a whole length of said right attachment and having also a pair of spaced circular apertures centrally located in an external wall of said right attachment and having a diameter commensurate with the external diameter of said front and back tubular elements, so that ends of said front and back tubular elements after traversing said external wall abut against said longitudinal vertical wall that is provided with attachment perforations corresponding to and coplanar with said pair of spaced circular apertures;

said left attachment having an identical structure with said right attachment and being so positioned to constitute a mirror image of said right attachment; and said front and back tubular elements incorporating in their interior means for capturing threaded ends of fasteners, the latter being used for securing together said one side of said pair of slides of ball bearing drawer type, said longitudinal vertical wall and, respectively, said front and back tubular elements.

2. The pants/skirts closet rack defined in claim 1, wherein said means for capturing threaded ends of fasteners, incorporated in each said front or back tubular element, comprising a pair of internal, diametrically opposed screw chases, intended to capture threaded ends of a predetermined diameter, said pair of internal, diametrically opposed screw chases, projecting from an internal surface of each said front and back tubular elements, extend along the whole length of the latter and each has, in cross-section, an annular discontinuous shape with an opening towards the longitudinal axis of symmetry of said front and back tubular elements.

3. A hanger adapted for use with a pants/skirts closet rack, said pants/skirts rack comprising right and left attachments;

front and back tubular elements; and a pair of slides of ball bearing drawer type;

each of said pair of slides of ball bearing drawer type being located, almost entirely, in an interior part of said right and left attachments, said front and back tubular elements, respectively their ends, penetrating into, without passing through, said right and left attachments, said ends being secured to said right and left attachments and to one side of said pair of slides of ball bearing drawer type, another side of said pair of slides of ball bearing drawer type being adapted to be secured to spaced vertical walls of a receptacle;

said hanger including a crossbar adapted to extend beneath and forwardly beyond right and left attachments and having a front end bent vertically and upwardly and then backwardly for forming a segment parallel to said crossbar, said segment further extending upwardly for forming a first backwardly directed front hook, said crossbar having also a back end bent vertically and upwardly and then backwardly for forming a second backwardly directed back hook, said first and second backwardly directed front and back hooks being coplanar with said crossbar and having the same height with respect to said crossbar and their openings being commensurate with the external diameter of said front and back tubular elements.

* * * * *